US007184568B2

(12) United States Patent
Chan

(10) Patent No.: US 7,184,568 B2
(45) Date of Patent: Feb. 27, 2007

(54) [SPEAKER]

(75) Inventor: Yen-Chen Chan, P.O.Box 108-00403, Taipei (TW) 106

(73) Assignee: Yen-Chen Chan, Hsin-Chuang (TW)

( * ) Notice: Subject to any disclaimer, the term of this patent is extended or adjusted under 35 U.S.C. 154(b) by 180 days.

(21) Appl. No.: 10/906,039

(22) Filed: Feb. 1, 2005

(65) Prior Publication Data

US 2006/0171557 A1 Aug. 3, 2006

(51) Int. Cl.
*H04R 25/00* (2006.01)

(52) U.S. Cl. ..... 381/433; 381/396

(58) Field of Classification Search ..... 381/124, 381/302, 396–398, 432–433
See application file for complete search history.

(56) References Cited

U.S. PATENT DOCUMENTS 3,356,796 A * 12/1967 Wray ..... 381/433
6,810,129 B2 * 10/2004 Nakada ..... 381/433

* cited by examiner

*Primary Examiner*—Suhan Ni

(57) ABSTRACT

A speaker having a locating ring mounted in an accommodating open chamber inside a basket to hold down a damper is disclosed. The basket has an annular bottom rib protruded from the bottom side of the accommodating open chamber around the center of the basket, and a plurality of radial reinforcing ribs formed integral with the annular bottom rib and radially extending over the annular bottom rib to the topmost edge of the basket and equiangularly spaced around the accommodating open chamber, each radial reinforcing rib having a groove extending along the length thereof inside the accommodating open chamber and a plurality of slots formed in the groove and cut through the annular bottom rib for guiding heat and noises out of the accommodating open chamber during operation of the speaker.

3 Claims, 6 Drawing Sheets

[SPEAKER]

BACKGROUND OF THE INVENTION

1. Field of the Invention

The present invention relates to a speaker and more particularly, to a basket for speaker that dissipates heat and eliminates noises during vibration of the damper.

2. Description of the Related Art

A speaker is an electro-acoustic transducer that converts electrical signals into sounds loud enough to be heard at a distance. It is used in broadcasting systems, stereo systems, TVs, computers, and various other audio/video electronic products. A speaker uses a voice coil in a magnet system to produce a magnetic induction that causes the voice coil to reciprocate along the axis of the magnet system and to further produce sound waves of different frequencies.

FIG. 5 shows a speaker according to the prior art. According to this design, the speaker comprises a basket A having a sound barrier A1, a cone B suspending in the sound barrier A1, a voice coil former B1 extending downward from the center of the cone B inside the basket A, a voice coil B2 mounted around the voice coil former B1, a flexible surround C joining the periphery of the cone B to the sound barrier A1 of the basket A, the flexible surround C having an arched face C1, a packing ring D fastened to the basket A to hold down the surround C, a sound chamber A11 defined between the cone B and the sound barrier A1, a damper E mounted in the bottom side inside the sound chamber A11 and closely attached to the periphery of the voice coil former B1, a diaphragm F fastened to the center of the cone B at the top, and a tweeter B11 installed in the diaphragm F. This structure of speaker is still not satisfactory in function due to the following drawbacks:

The inside temperature of the sound chamber A11 will rise during vibration of the sound coil B2 in the basket A. However, because the sound chamber A11 is an enclosed chamber, heat cannot be quickly dissipated out of the sound chamber A11 into the outside air.

Because the sound chamber A11 is an enclosed chamber, vibration of the damper E with the voice coil B2 will produce resonance noises that cannot be quickly eliminated by the cone B and will affect the quality of the sound waves.

FIG. 6 shows another structure of speaker according to the prior art. According to this design, the basket G has a plurality of air vents G11 in the periphery of the base G1 thereof for dissipation of heat during vibration of the damper with the voice coil (not shown). However, due to the limitation of the location of the annular rib G2 around the base G1 of the basket G, the size of the air vents G11 is limited. Because the air vents G11 are small and spaced from the damper at a distance, heat cannot be efficiently carried away from the inside space of the basket G. Further, the air vents G11 do not allow circulation of air between the inside space of the basket G and the outside open air, and vibration noises will be accumulated inside the basket G to affect the quality of the sound waves.

SUMMARY OF THE INVENTION

The present invention has been accomplished under the circumstances in view. It is therefore the main object of the present invention to provide a speaker, which quickly dissipates heat during vibration of the damper. It is another object of the present invention to provide a speaker, which eliminates noises when producing sound waves.

To achieve these and other objects of the present invention, the speaker comprises a basket, which comprises an accommodating open chamber, an annular bottom rib protruded from a bottom side of the accommodating open chamber around the center of the basket, and a plurality of radial reinforcing ribs formed integral with the annular bottom rib and radially extending over the annular bottom rib to the topmost edge of the basket and equiangularly spaced around the accommodating open chamber, a damper mounted in the accommodating open chamber inside the basket, and a locating ring mounted in the accommodating open chamber inside the basket to hold down the damper, wherein the radial reinforcing ribs each have a groove extending along the length thereof inside the accommodating open chamber and a plurality of slots formed in the groove and cut through the annular bottom rib for guiding heat and noises out of the accommodating open chamber during operation of the speaker.

DETAILED DESCRIPTION OF THE PREFERRED EMBODIMENT

Figure 1:
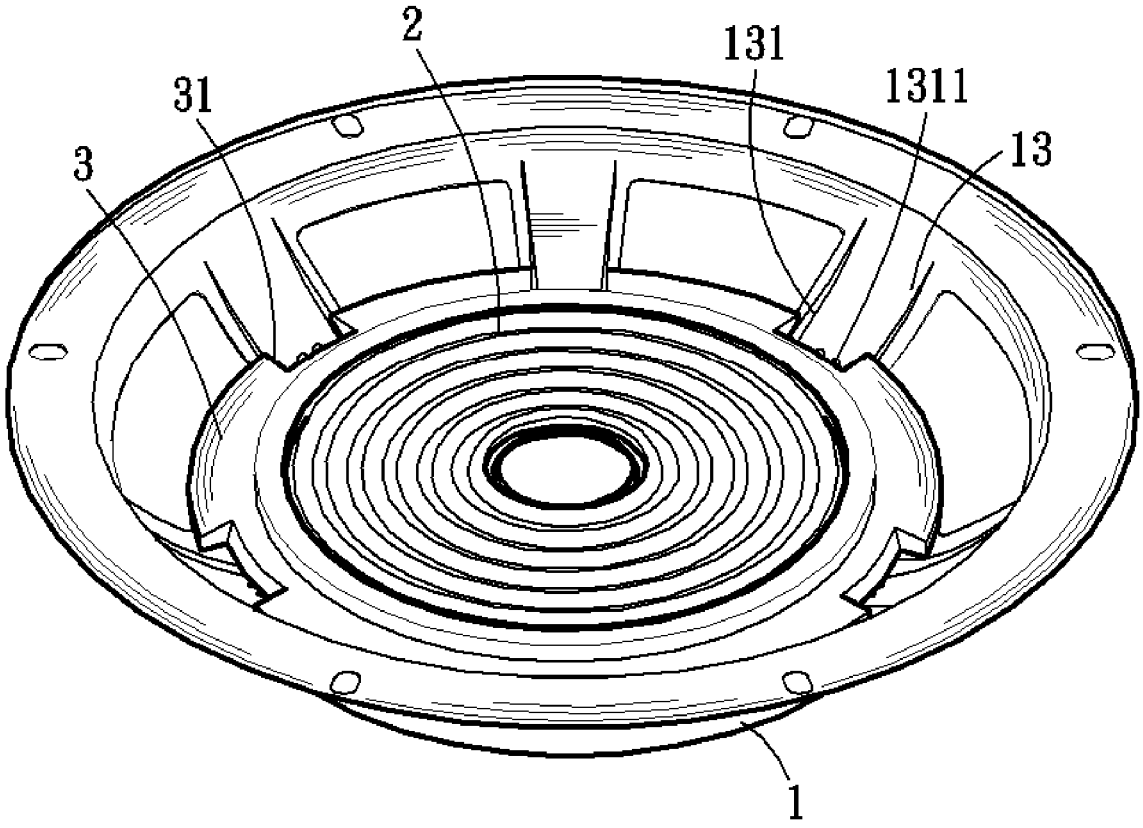
FIG. 1 is an elevational front view of a speaker according to the present invention.
Figure 2:
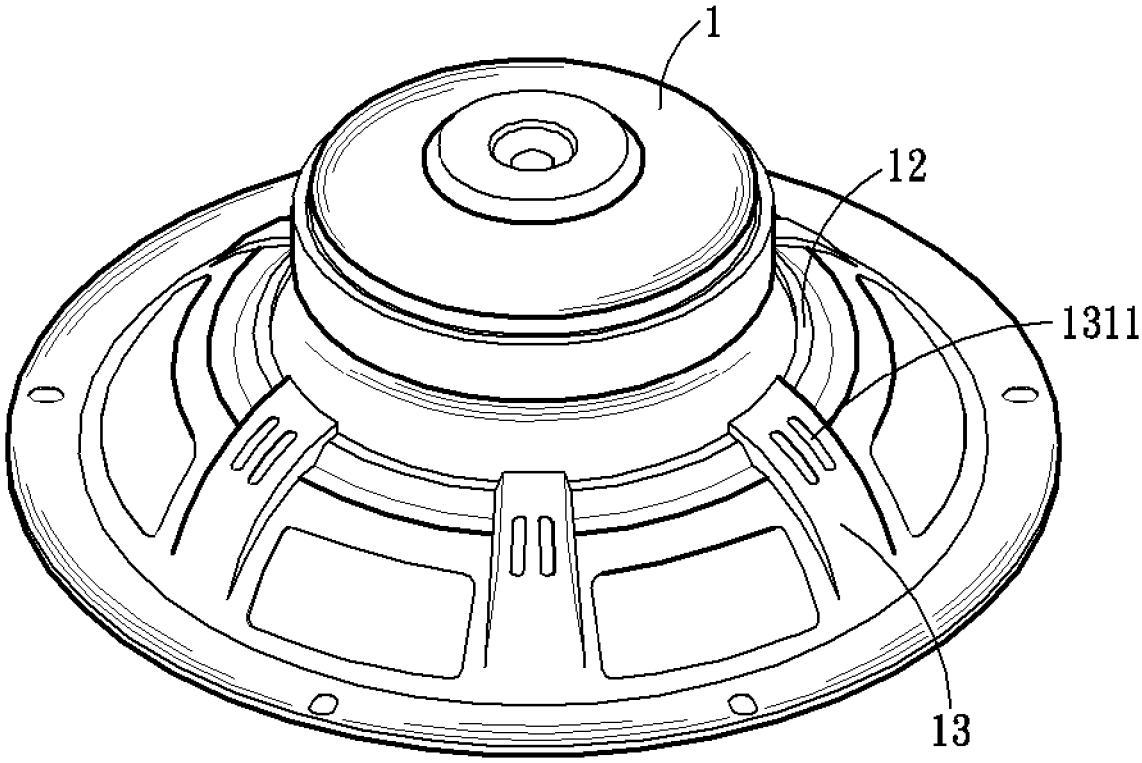
FIG. 2 is an elevational rear side view of the speaker according to the present invention.
Figure 3:
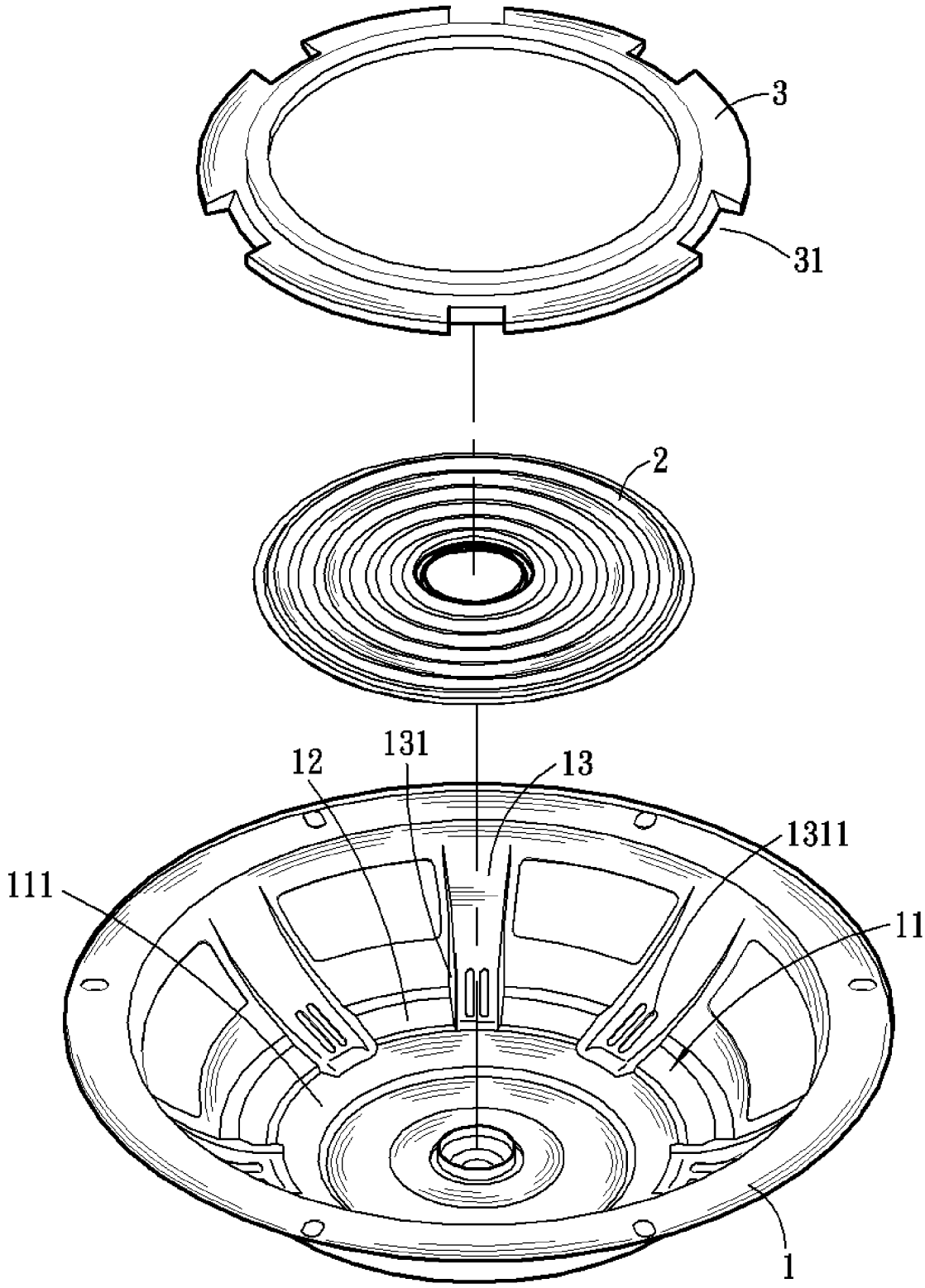
FIG. 3 is an exploded view of the speaker according to the present invention.

Referring to FIGS. 1~3, a speaker in accordance with the present invention is shown comprising a basket 1, a damper 2, and a locating ring 3.

The basket 1 is shaped like a hopper, comprising an accommodating open chamber 11, an annular bottom rib 12 protruded from a bottom side 111 of the accommodating open chamber 11 around the center, and a plurality of radial reinforcing ribs 13 formed integral with the annular bottom rib 12 and radially extending over the annular bottom rib 12 to the top side of the basket 1 and equiangularly spaced around the accommodating open chamber 11. The radial reinforcing ribs 13 each have a groove 131 extending along the length thereof inside the accommodating open chamber 11 and a plurality of slots 1311 formed in the groove 131 and cut through the annular bottom rib 12. The slots 1311 can be oblong through holes.

The damper 2 is mounted in the accommodating open chamber 11 of the basket 1, having a corrugated surface.

The locating ring 3 is mounted in the accommodating open chamber 11 of the basket 1 to hold down the damper 2, having a plurality of peripheral notches 31 corresponding to the radial reinforcing ribs 13 of the basket 1.

During installation, the damper 2 is put in the accommodating open chamber 11 of the basket 1, and then the locating ring 3 is press-fitted into the accommodating open chamber 11 of the basket 1 to hold down the border area of the damper 2, keeping the peripheral notches 31 of the locating ring 3 respectively connected to the grooves 131 of the radial reinforcing ribs 13 above the slots 1311. The assembly thus obtained is then mounted with other speaker parts, such as cone, surround, voice coil former, magnet system, and etc., to form a finished speaker. Because the other parts of the speaker are of the known art and not within the scope of the claims of the present invention, no further detailed description in this regard is necessary.

Figure 4:
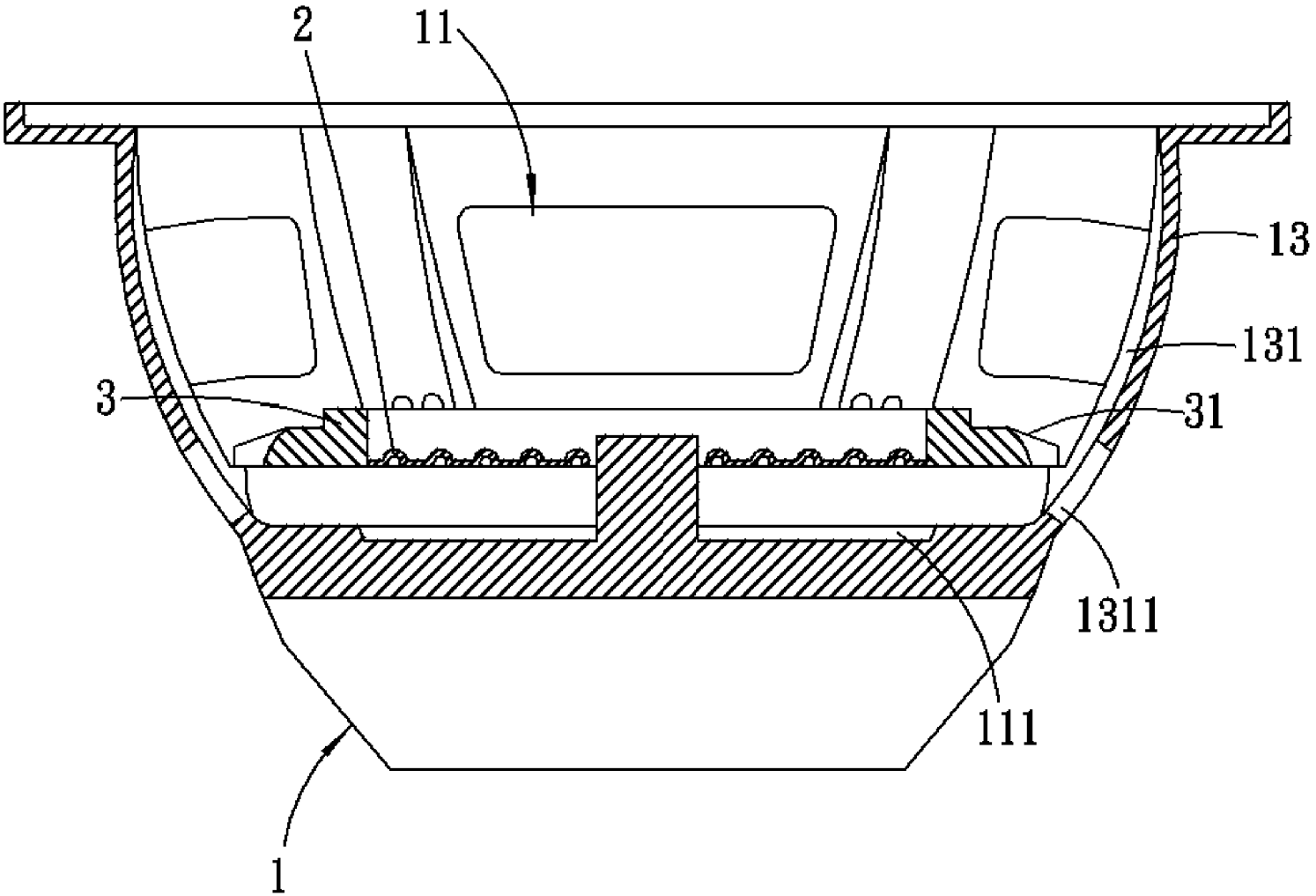
FIG. 4 is a side view in section of the speaker according to the present invention.
Figure 5:
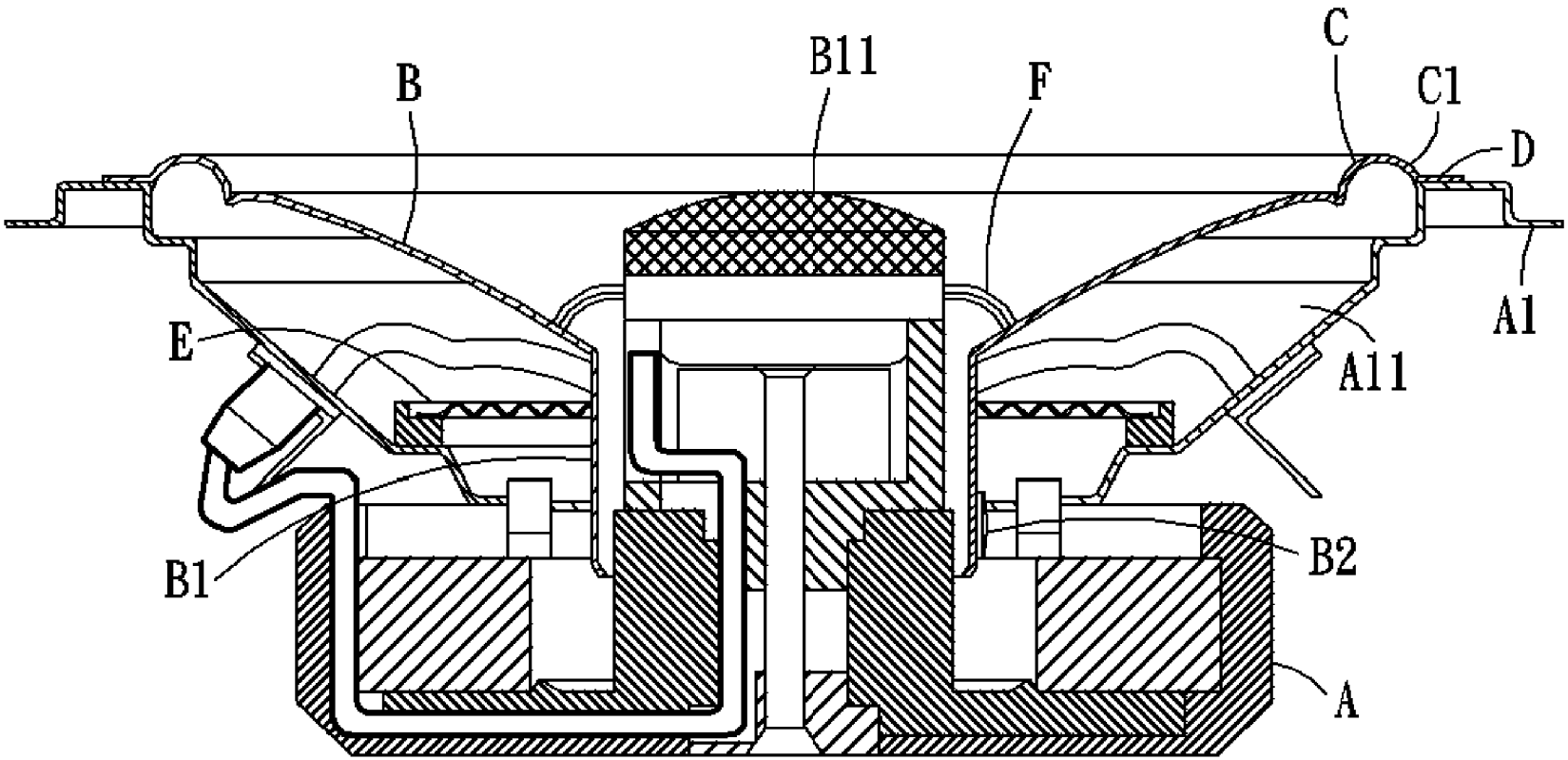
PRIOR ART FIG.5
FIG. 5 is a sectional side view of a speaker according to the prior art.
Figure 6:
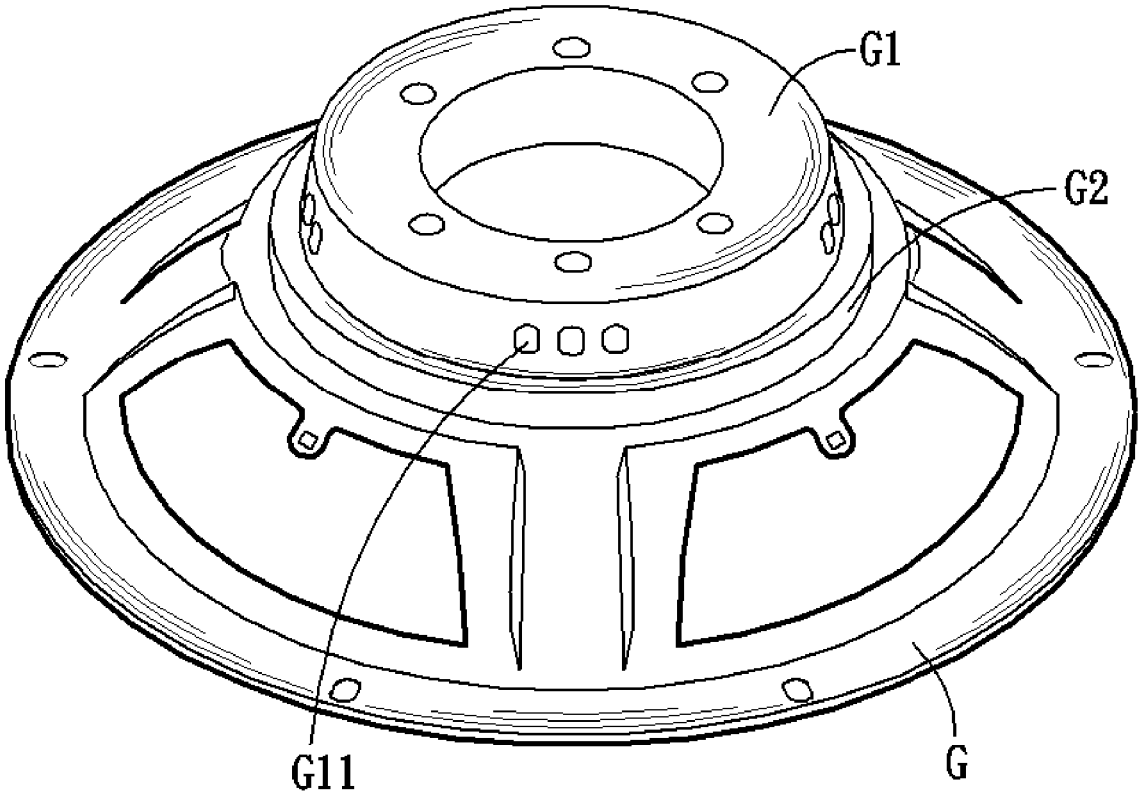
PRIOR ART FIG.6
FIG. 6 is an elevational rear side view of another structure of speaker according to the prior art.

Referring to FIG. 4 and FIG. 3 again, during operation of the speaker, the damper 2 is vibrated with voice coil to produce sound waves. During vibration of the damper 2, a heat energy is produced, which is immediately dissipated into the outside air through the slots 1311 in the grooves 131 of the radial reinforcing ribs 13. Therefore, the invention prevents accumulation of heat inside the speaker, prolonging the service life of the basket 1 and the damper 2. Further, during vibration of the damper 2, sound waves will collide with air in the accommodating open chamber 11 to produce noises, which will immediately be guided out of the speaker through the slots 1311 in the grooves 131 of the radial reinforcing ribs 13. Because the air inside the basket 1 can be exchanged with the outside air through the slots 1311 in the grooves 131 of the radial reinforcing ribs 13, the invention eliminates noises during vibration of the damper 2, thereby maintaining the quality of the sound waves of the speaker.

As indicated above, the speaker of the present invention has the following advantages:

1. Because the radial reinforcing ribs 13 are formed integral with the annular bottom rib 12 and radially extending over the annular bottom rib 12 to the top side of the basket 1 and equiangularly spaced around the accommodating open chamber 11, the formation of the slots 1311 does not obstruct the structural strength of the annular bottom rib 12, and the slots 1311 can be made having a certain length.

2. During vibration of the damper 2, heat thus produced can be quickly dissipated into the outside air through the slots 1311.

3. During vibration of the damper 2, noises that are produced due to collision of sound waves will air can be quickly guided out of the basket 1 through the slots 1311, thereby maintaining the quality of the sound waves of the speaker.

A prototype of speaker has been constructed with the features of FIGS. 1~4. The speaker functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A speaker comprising:

a basket, said basket comprising an accommodating open chamber, an annular bottom rib protruded from a bottom side of said accommodating open chamber around the center of said basket, and a plurality of radial reinforcing ribs formed integral with said annular bottom rib and radially extending over said annular bottom rib to the topmost edge of said basket and equiangularly spaced around said accommodating open chamber;

a damper mounted in said accommodating open chamber inside said basket; and a locating ring mounted in said accommodating open chamber inside said basket to hold down said damper;

wherein said radial reinforcing ribs each have a groove extending along the length thereof inside said accommodating open chamber and a plurality of slots formed in said groove and cut through said annular bottom rib for guiding heat and noises out of said accommodating open chamber during operation of said speaker.

2. The speaker as claimed in claim 1, wherein said slots are oblong through holes.

3. The speaker as claimed in claim 1, wherein said locating ring has a plurality of peripheral notches corresponding to the grooves of said radial reinforcing ribs of said basket.

* * * * *